US010202563B2

(12) United States Patent
Sato et al.

(10) Patent No.: US 10,202,563 B2
(45) Date of Patent: Feb. 12, 2019

(54) CLEANING FLUID AND CLEANING METHOD

(71) Applicant: SAKATA INX CORP., Osaka-shi, Osaka (JP)

(72) Inventors: Yoichi Sato, Osaka (JP); Kazuki Moriyasu, Osaka (JP)

(73) Assignee: SAKATA INX CORP. (JP)

( * ) Notice: Subject to any disclaimer, the term of this patent is extended or adjusted under 35 U.S.C. 154(b) by 0 days.

(21) Appl. No.: 15/506,776

(22) PCT Filed: Jul. 1, 2015

(86) PCT No.: PCT/JP2015/069014

§ 371 (c)(1),
(2) Date: Feb. 27, 2017

(87) PCT Pub. No.: WO2016/042883

PCT Pub. Date: Mar. 24, 2016

(65) Prior Publication Data

US 2017/0275561 A1 Sep. 28, 2017

(30) Foreign Application Priority Data

Sep. 19, 2014 (JP) ..... 2014-191334

(51) Int. Cl.

| | |
|---|---|
| ***C11D 1/75*** | (2006.01) |
| ***C11D 1/88*** | (2006.01) |
| ***B41M 5/00*** | (2006.01) |
| ***B41J 2/165*** | (2006.01) |
| ***C11D 1/90*** | (2006.01) |
| ***B41J 29/17*** | (2006.01) |
| ***C11D 1/62*** | (2006.01) |
| ***C11D 3/00*** | (2006.01) |
| ***C11D 3/16*** | (2006.01) |
| ***C11D 3/04*** | (2006.01) |
| ***C11D 11/00*** | (2006.01) |

(52) U.S. Cl.

CPC ..... *C11D 1/88* (2013.01); *B41J 2/165* (2013.01); *B41J 2/16552* (2013.01); *B41J 29/17* (2013.01); *B41M 5/00* (2013.01); *C11D 1/62* (2013.01); *C11D 1/75* (2013.01); *C11D 1/90* (2013.01); *C11D 3/0047* (2013.01); *C11D 3/044* (2013.01); *C11D 3/16* (2013.01); *C11D 11/0041* (2013.01); *B41P 2235/50* (2013.01)

(58) Field of Classification Search

CPC ..... C11D 1/75; C11D 3/044
USPC ..... 510/503, 170, 174
See application file for complete search history.

(56) References Cited

U.S. PATENT DOCUMENTS

| | | | | |
|---|---|---|---|---|
| 4,554,091 | A * | 11/1985 | Jones | C11D 3/3746 252/186.43 |
| 4,789,495 | A * | 12/1988 | Cahall | C11D 3/3953 252/187.25 |
| 5,780,412 | A * | 7/1998 | Scarborough | C04B 41/009 106/287.12 |
| 6,017,872 | A * | 1/2000 | Pedersen | C11D 1/37 510/201 |
| 6,376,448 | B1 * | 4/2002 | Colurciello, Jr. | C11D 1/825 510/384 |
| 6,750,190 | B2 * | 6/2004 | Colurciello | C11D 1/835 510/238 |
| 6,933,267 | B2 * | 8/2005 | Colurciello | C11D 1/835 510/238 |
| 2002/0145653 | A1 | 10/2002 | Reboa et al. | |
| 2014/0371124 | A1 | 12/2014 | Harada et al. | |

FOREIGN PATENT DOCUMENTS

| | | |
|---|---|---|
| CN | 103468055 | 12/2013 |
| JP | 2000127419 | 5/2000 |
| JP | 2002332442 | 11/2002 |
| JP | 2004292707 | 10/2004 |
| JP | 2009155424 | 7/2009 |
| JP | 2012067152 | 4/2012 |
| WO | 2013122172 | 8/2013 |

OTHER PUBLICATIONS

International Search Report, International Application No. PCT/JP2015/069014, dated Jul. 28, 2015.
Supplementary Partial European Search Report, EP Application No. 15841410, dated Mar. 7, 2018.

* cited by examiner

*Primary Examiner* — Gregory E Webb
(74) *Attorney, Agent, or Firm* — Perman & Green, LLP

(57) ABSTRACT

A cleaning fluid for cleaning a site to which ink adheres in an inkjet printer which ejects aqueous inkjet ink containing a pigment and alkali-soluble resin having an acid group in a molecule, wherein the cleaning fluid contains an amphoteric surfactant, a basic compound, and water, a pH range of the cleaning fluid is from 9 to 12, the amphoteric surfactant is at least one selected from a group consisting of dimethyl lauryl amine oxide, lauryl dimethyl amino acetic acid betaine and a 2-al-kyl-n-carboxymethyl-n-hydroxyethyl imidazolinium betaine and is contained in an amount of 0.1 to 3% by mass to the total amount of the cleaning fluid.

10 Claims, No Drawings

CLEANING FLUID AND CLEANING METHOD

CROSS REFERENCE TO RELATED APPLICATIONS

This application is the National Stage of International Application No. PCT/JP2015/069014 having International Filing Date, 1 Jul. 2015, which designated the United States of America, and which International Application was published under PCT Article 21(2) as WO Publication No. 2016/042883 A1, and which claims priority from, and the benefit of, Japanese Patent Application No. 2014-191334, filed on 19 Sep. 2014, the disclosures of which are incorporated herein by reference in their entireties.

BACKGROUND

1. Field

The presently disclosed embodiment relates to a cleaning fluid and a cleaning method. More particularly, the presently disclosed embodiment relates to, in an inkjet printer which ejects aqueous inkjet ink containing pigment and alkali-soluble resin having an acid base in a molecule, a cleaning fluid and a cleaning method for cleaning a site to which the aqueous inkjet ink being ejected adheres.

2. Brief Description of Related Developments

Inkjet type printing is a technique which employs an inkjet printer to eject an ink droplet from an extremely fine nozzle to a printing substrate and form a colored image, such as letters and patterns. Inkjet type printing does not require a plate making process and can perform high-quality printing with a quite simple configuration of apparatus. Therefore, inkjet type printing has many advantages that are hard to get with other techniques. Inkjet printers employing inkjet type printing have been very popular in the field of personal use, such as individual use or use at home.

On the other hand, in industrial use, where an incompatibly larger quantity of printed matter than in personal use is produced, various kinds of performance characteristics are additionally required. First, high speed printability is essential to improve producibility. Also, the printed matter is wound or superimposed soon after being printed. Thus, the printed matter needs to be dried sufficiently so that the printed surface is not contaminated and do not stain the back side of printing paper which contacts the printed surface. It is also important that cost of the printed matter is low. Especially, printed matter in industrial use, even without employing dedicated paper as used in personal use, must achieve sufficient print quality. Of course, ink for producing printed matter of industrial use must have performance characteristics of ink required essentially for inkjet type printing, too. Major examples of such performance characteristics include preservation stability with time, ejection reliability allowing stable ejection without causing nozzle clogging, flying capacity for a droplet to impact exactly on a target position, water resistance and rubfastness of print material, and the like.

As stated above, for employing inkjet type printing in industrial use, many of performance characteristics of ink has yet to be improved. However, considering the recent trend toward multi-kind and small lot of print material, and the like in the printing industry, inkjet type printing, if improved in print speed and print quality on low-cost printing paper, is worth employing, even in competition with other types of printing. Therefore, in an effort to employ inkjet type printing in industrial use, technique achieving high speed printing and decorative printing on low-cost printing paper has been actively developed in terms of a printer, ink, printing method, and the like.

First, in order to achieve high speed printing, a lot of ink droplets have to be ejected onto a predetermined position in a shorter time. Then, attempts have been made to increase nozzles ejecting ink droplets. Specifically, a method of single-pass printing using a fixed line head has been developed. However, inkjet type printing is mechanically restricted that droplets cannot be ejected until filling of ink into a nozzle is finished. Therefore, in inkjet type printing a time lag occurs by the next ejection at least for a duration as long as ink is filled into a nozzle. Therefore, for faster printing, improving performance of ink itself is considered so that filling of ink is finished more quickly. For example, there have been attempts to lower ink viscosity.

Next, in order to achieve cost reduction, it has been considered to employ uncoated paper, such as cheap plain paper and regular offset paper, which are not specially processed to enhance print suitability for printing paper. However, fibers of such printing paper are sparse and a liquid component of ink tends to permeate deeply into the paper (fibers). This tendency becomes evident when low-viscosity ink is used. If, with a liquid component of ink, a coloring component is permeated into paper, density and clearness of a printed image are reduced. When a liquid component of ink spreads along fibers on a surface of paper, bleeding occurs. Either case impairs print quality of printed matter. Therefore, when plain paper and regular offset paper are used, measures are required to prevent occurring of reduced density and clearness and of bleeding.

The problem of lowering ink viscosity and inhibiting permeation of a coloring component into paper at the same time and a problem of improving drying property and ejection reliability at the same time respectively cannot be improved without altering physical properties of ink in the opposite direction. Thus, it is difficult to improve these conflicting problems at the same time.

Then, in aqueous ink, in order to lower ink viscosity and achieve a quick drying property and inhibition of permeation of a coloring component into paper, a method of desorbing an aqueous medium from the system quickly when the ink impacts on a paper surface has been considered. For example, one is a technique introducing a highly hydrophobic portion of a long chain alkyl group, an aromatic ring, and the like into a molecule as binder resin and using alkali-soluble resin designed to have a low acid value in the smallest possible amount so that low viscosity of the ink is maintained while increasing a concentration of pigment as high as possible. Furthermore, regarding preservation stability and ejection reliability which tend to be reduced due to this technique, a technique has been considered, in which this binder resin is deposited on a surface of pigment and coats the surface of the pigment for maintaining the preservation stability and ejection reliability.

However, in this method, once ink is dried and solidified, it is hard to redissolve. Therefore, in an inkjet printer and the like which has been left for long time without ejecting ink, a dry film of the ink is formed on a head (near a nozzle tip) or in a nozzle. The dry film tends to be a cause of curved flight of ink and nozzle clogging.

Then, a technique employing ink cleaning fluid to remove a dry film of ink accumulated in a head or a nozzle has been suggested. For example, Japanese Patent Document No. 2009-155424A discloses a method employing a two-component cleaning fluid for inkjet head which consists of two kinds of cleaning water containing different surfactants.

Japanese Patent Document No. 2000-127419A discloses a nozzle cleaning fluid for an inkjet recording head which contains surfactant, a basic compound, and water and has a pH of 9 or higher. Japanese Patent Document No. 2012-067152A discloses a method of cleaning a hard surface with aqueous detergent containing alkali chemical, alkylamine oxide, and particular organic solvent.

SUMMARY

However, the cleaning fluid described in Japanese Patent Document No. 2009-155424A has weak cleaning effect. Thus, it takes long for maintenance. Also, this cleaning fluid does not show sufficient cleaning effect in a condition where cleaning is difficult, such as with ink to which a method increasing particularly a concentration of pigment and using alkali-soluble resin which is low in redissolubility as binder resin applied to or such as when an ink film is solidified in a head or a nozzle. Cleaning ability of the cleaning fluid described in Japanese Patent Document No. 2000-127419A is significantly unstable. This cleaning fluid shows relatively weak cleaning ability, particularly in the above condition where cleaning is difficult. A method described in Japanese Patent Document No. 2012-067152A uses a cleaning fluid including an aromatic hydrocarbon compound, such as benzene and toluene, and a ketone-based compound, such as methyl ethyl ketone and acetone. Thus, in the cleaning method described in Japanese Patent Document No. 2012-067512A, when the method is applied to an inkjet printer using a lot of polymer members, a wetted part to the cleaning fluid is immersed in organic solvent.

The presently disclosed embodiment was made in view of such conventional problems and aims to provide, in an inkjet printer which ejects aqueous inkjet ink, a cleaning fluid and cleaning method with cleaning effect which is able to clean a site to which the aqueous inkjet ink being ejected adheres to dissolve a dry film of the ink and to improve defective ejection.

The present inventors obtained the knowledge below as a result of earnest investigation for solving the above problems. That is, the present inventors speculated that because the air was hydrophobic, a dry film of ink has a structure in which hydrophobic portions of the pigment and binder resin (including alkali-soluble resin having an acid group in a molecule) were exposed at many parts of a surface of the dry film and an acid group of the resin faces inward of the film of the ink. Also, the present inventors speculated that when ink had a high pigment concentration and alkali-soluble resin having highly hydrophobic portions introduced in a molecule was used as binder resin so that the ink had a quick drying property while its low viscosity was maintained (especially when a small amount of alkali-soluble resin having a low acid value was used), portions (e.g., an acid group) which acted to redissolve the ink at a surface of a dry film would inevitably decreases and cleaning would be more difficult.

In order to quickly dissolve and remove (clean off) a dry film of ink, salt of an acid group of alkali-soluble resin and a basic compound contained in a cleaning fluid needs to be formed more quickly. Therefore, according to the above speculations, it is speculated that for a cleaning fluid a feature of moistening alkali-soluble resin, in a condition that hydrophobic portions of pigment and binder resin are exposed at many parts of a surface of a dry film is important. Surfactant reduces the surface tension of a cleaning fluid and heightens its moistening performance to a hydrophobic surface.

However, in a further study, the present inventors have found that in the difficult cleaning condition as described above, just decreasing the surface tension of a cleaning fluid does not achieve sufficient cleaning, and it had selectivity of material. In other words, it has been found that, for example, when a dry film is firmly formed cleaning may not be effective at all and the dry film may not be cleaned off sufficiently depending on the type of surfactant. Then, the present inventors speculated that a feature which widens the intermolecular distance of binder resin to allow further immersion of a cleaning fluid (ability to swell resin) would be needed so that a basic compound contained in the cleaning fluid and an acid group of the binder resin facing inward of a film of ink film would form salt. Then, the present inventors intensely studied compounds acting as amphoteric surfactant because they had higher absorption power between a hydrophobic portion of binder resin and themselves and were able to collect more water molecules at a hydrophilic portion, among compounds having a hydrophobic portion (generally a long-chain alkyl group or an aromatic ring) and a hydrophilic portion (generally an ionizable group or a polyethylene chain) which would be employed as a component of a cleaning fluid, found that the cleaning fluid which had sufficient cleaning performance even in the difficult cleaning condition as described above could be obtained, and completed the presently disclosed embodiment.

In other words, the cleaning fluid of one aspect of the presently disclosed embodiment which solves the above problems is a cleaning fluid for cleaning a site to which a aqueous inkjet ink being ejected adheres in an inkjet printer which ejects the aqueous inkjet ink containing a pigment and an alkali-soluble resin having an acid group in a molecule, wherein the cleaning fluid contains an amphoteric surfactant, a basic compound, and water, a pH range of the cleaning fluid is from 9 to 12, the amphoteric surfactant is at least one selected from a group consisting of dimethyl lauryl amine oxide, lauryl dimethyl aminoacetic acid betaine, and 2-alkyl-n-carboxymethyl-n-hydroxyethyl imidazolium betaine and is contained in an amount of 0.1 to 3% by mass to the total amount of the cleaning fluid. It should be noted that there is no particular limitation to the adhesion site as long as it is a site to which ink being ejected may adhere. As examples of such adhesion site, an inner passage through which ink stored in a ink tank passes until it is ejected from a nozzle hole provided on a head, a surface of the head, the periphery of the nozzle hole are shown.

Also, the cleaning method of another aspect of the presently disclosed embodiment is a cleaning method for cleaning a site with a cleaning fluid to which an aqueous inkjet ink being ejected adheres in an inkjet printer which ejects aqueous inkjet ink containing a pigment and an alkali-soluble resin having an acid group in a molecule, wherein the cleaning fluid contains an amphoteric surfactant which is at least one selected from a group consisting of dimethyl lauryl amine oxide, lauryl dimethyl aminoacetic acid betaine, and 2-alkyl-n-carboxymethyl-n-hydroxyethylimidazoliumbetaine,abasic compound, and water, a pH range of the cleaning fluid is from 9 to 12, the amphoteric surfactant is contained in an amount of 0.1 to 3% by mass to the total amount of the cleaning fluid, and the cleaning fluid is fed to the site to which the aqueous inkjet ink adheres.

DETAILED DESCRIPTION

<Cleaning Fluid>

Cleaning fluid of one aspect of the disclosed embodiment is explained in detail. The cleaning fluid of the present aspect is, in an inkjet printer ejecting aqueous inkjet ink (which may be hereinafter referred to as just ink) which contains pigment and alkali-soluble resin having an acid group in a molecule, a cleaning fluid for cleaning an adhesion site to which the ink being ejected adheres. Also, the cleaning fluid of the present aspect contains an amphoteric surfactant, a basic compound, and water.

<Amphoteric Surfactant>

The amphoteric surfactant is blended in the cleaning fluid to dissolve and remove the ink. The cleaning fluid of the present aspect particularly contains amphoteric surfactant among surfactants of all. Also, the amphoteric surfactant is at least one selected from a group consisting of dimethyl lauryl amine oxide, lauryldimethyl aminoacetic acid betaine, and 2-alkyl-n-carboxymethyl-n-hydroxyethyl imidazolium-betaine. Among these, for the amphoteric surfactant, it is preferable that dimethyl lauryl amine oxide is selected to be contained because of the fact that even when a dry film of the ink is firmly formed it is able to sufficiently dissolve and remove the dry film, and it is more preferable that dimethyl lauryl amine oxide is contained more than other amphoteric surfactants. Furthermore, it is even more preferable to use dimethyl lauryl amine oxide alone.

The amount of the amphoteric surfactant is supposed to be 0.1% by mass or more to the total amount of the cleaning fluid and is preferably 0.5% by mass or more. Also, the amount of the amphoteric surfactant is supposed to be 3% by mass or less to the total amount of the cleaning fluid and preferably does not exceed the amount which can avoid lowering of cost effectiveness, such as when improvement of cleaning performance cannot be expected. When the amount of the amphoteric surfactant is less than 0.1% by mass, cleaning performance of the cleaning fluid reduces. On the other hand, when the amount of the amphoteric surfactant is more than 3% by mass, foaming tends to occur and handling of the cleaning fluid tends to become worse. Also, when the amount of the amphoteric surfactant is more than 3% by mass, improvement of the cleaning performance cannot be expected and there tends to be an obstacle in handling according to occupational health.

<Basic Compound>

The basic compound is blended in the cleaning fluid in order to adjust its pH to be in a range as stated below and enhance cleaning power of the amphoteric surfactant. There is no particular limitation to the basic compound of the present aspect. As examples of the basic compounds, inorganic or organic basic compounds are shown. As examples of the inorganic basic compounds, hydroxides of alkali metals are shown. As examples of the organic basic compounds, low molecular weight primary, secondary or tertiary organic amine compounds are shown. Among these, for the basic compound, hydroxides of alkali metals are preferable because of the fact that they are strong base and can sufficiently enhance the cleaning effect, and sodium hydroxide and potassium hydroxide are more preferable.

The amount of the basic compound is supposed to be an amount needed for adjusting the pH of the cleaning fluid to be in a range as stated below. Such amount may vary according to the basicity of the basic component itself or by including an acid component or a basic component into other materials.

<Water>

Water is blended in order to dissolve the above amphoteric surfactant and basic compound. As examples of the water, purified water, deionized water, and the like are shown. There is no particular limitation to the amount of the water as far as it is an amount possible to dissolve the amphoteric surfactant and the basic compound.

<Optional Component>

The cleaning fluid of the present aspect may contain an optional component in addition to the above amphoteric surfactant, basic compound, and water, as long as it does not lower the ink performance. As examples of the optional components, organic solvent, antiseptic, surfactant other than the above amphoteric surfactant, antifoamer, and the like which do not dissolve a resin member and the like used as a component part of an aqueous inkjet printer are shown. It should be noted that an amount of organic solvent which possibly injures a component part of an aqueous inkjet printer is preferably limited so that it may not injure a member and more preferably organic solvent is not be blended.

Back to explaining the cleaning fluid, there is no particular limitation to the method of preparing the cleaning fluid of the present aspect. The cleaning fluid may be prepared as a single agent by blending all of the above components, or a first agent in which the above amphoteric surfactant and water are blended and a second agent in which the above basic compound and water are blended maybe separately prepared. When the first agent and the second agent are prepared separately, they are supposed to be blended when the cleaning fluid of the present aspect is provided to an adhesion site.

In this present aspect, the pH of the cleaning fluid (or the pH of the cleaning fluid in a blended state, if the cleaning fluid is prepared with the first agent and the second agent separately) is 9 to 12. When the pH is less than 9, cleaning performance of the cleaning fluid tends to be lowered. On the other hand, when the pH of the cleaning fluid is more than 12, it is likely to cause issues related to occupational health and erode an adhesion site (e.g. a member of a head).

The cleaning fluid prepared in the way as mentioned above is used in an inkjet printer ejecting ink which contains pigment and alkali-soluble resin having an acid group in a molecule for cleaning an adhesion site to which the ink being ejected adheres. The alkali-soluble resin is blended as binder resin for the pigment. A cleaning method using the cleaning fluid will be described below.

<Pigment>

There is no particular limitation to the pigment comprised in the ink. Examples of the pigment include various kinds of inorganic pigment and organic pigment. Examples of the inorganic pigment include carbon black, titanium oxide, red iron oxide, graphite, black iron oxide, chrome oxide green, aluminum oxide, and the like. Examples of the organic pigment include dye lake pigment, azo-based pigment, benzimidazolone-based pigment, phthalocyanine-based pigment, quinacridone-based pigment, anthraquinone-based pigment, dioxazine-based pigment, indigo-based pigment, thioindigo-based pigment, perylene-based pigment, perynone-based pigment, diketopyrrolopyrole-based pigment, isoindolinone-based pigment, nitro-based pigment, nitrone-based pigment, anthraquinone-based pigment, flavanthrone-based pigment, quinophthalone-based pigment, pyranthrone-based pigment, indanthrone-based pigment, and the like. These pigments may be used together.

There is no particular limitation to an amount of the pigment in the ink. Here, when a large amount of the pigment is contained in the ink, color density of printing can be maintained even with a decreased amount of ink droplets. As a result, transferring of a liquid component to printing paper decreases and that leads to advantages to quick drying property and inhibition of permeation of a coloring component into printing paper. On the other hand, the total amount of the solid content in the ink needs to be kept constant in order to maintain the ink in low viscosity. Therefore, as an amount of the pigment, which is an insoluble component, increases, an amount of the alkali-soluble resin, which is a soluble component, needs to be decreased, instead. As a result of combination of these, such ink tends to form a dry film which is low in redissolubility and cause defective ejection. However, the cleaning fluid of the present aspect has sufficient cleaning performance and is able to clean and remove even a dry film of the ink containing a large amount of such pigment. Specifically, the cleaning fluid is able to sufficiently clean and remove even a dry film of the ink containing the pigment in an amount of 8 to 12% by mass to the total amount of the ink.

<Alkali-Soluble Resin>

Examples of the alkali-soluble resin include alkali-soluble resin obtained by copolymerizing carboxyl group-containing monomers, such as acrylic acid, methacrylic acid, and maleic (anhydride) monoalkyl ester, with hydrophobic group-containing monomers, including alkyl group-containing monomers having 8 carbon atoms or more, such as 2-ethylhexyl (meth)acrylate, octyl(meth)acrylate,lauryl (meth)acrylate,stearyl(meth)acrylate, and 2-hydroxy stearyl (meth)acrylate, alkyl vinyl ethers having 8 carbons or more, such as dodecyl vinyl ether, alkyl vinyl esters having 8 carbon atoms or more, such as vinyl 2-ethylhexanoate, vinyl laurate, and vinyl stearate alicyclic hydrocarbon group-containing monomers, such as cyclohexylmethacrylate, and aromatic hydrocarbon-containing monomers, such as benzyl (meth)acrylate, styrene, α-styrene, and vinyltoluene.

The amount of the alkali-soluble resin is, for example, approximately 10 to 60 parts mass to 100 parts by mass of the pigment.

There is no particular limitation to the acid value of the alkali-soluble resin. When the acid value of the alkali-soluble resin is low, desorption of an aqueous medium to the outside of the system becomes easier to occur and the ink has a characteristic of an excellent drying property. On the other hand, in such ink, portions which act to redissolve a dry film of the ink tend to decrease. However, the cleaning fluid of the present aspect shows excellent performance in effectively reacting a basic group of the basic compound contained in the cleaning fluid with an acid group contained in a molecule of the alkali-soluble resin and forming salt, and it can clean and remove even a dry film of such ink. Specifically, the cleaning fluid is able to sufficiently clean and remove even a dry film of the ink which contains alkali-soluble resin having an acid value of 100 to 200mg KOH/g.

Back to explaining the ink, for the ink of the present aspect, the above pigment is used after being mixed with aqueous resin varnish which is obtained by dissolving the alkali-soluble resin into the water under the presence of the basic compound, being kneaded by a disperser, and then being prepared to become resin-coated pigment in which the alkali-soluble resin is deposited on the pigment surface by means of an acid deposition method, an ion exchange method, and the like. Such ink can have a high content of the pigment and can be prepared by blending a small amount of the alkali-soluble resin having a low acid value. As a result, the ink has a quick drying property with low viscosity, making itself applicable to high-speed printing. Also, the ink has excellent performance: it achieves an excellent print quality even without using expensive paper dedicated for printing, shows good preservation stability and water resistance, and so on.

On the other hand, with such ink, especially when it has a high content of the pigment or when a small amount of the alkali-soluble resin having a low acid value is blended therein, curved flight and nozzle clogging due to drying and solidification of the ink are likely to occur. However, according to the cleaning fluid of the present aspect, the cleaning fluid contains the above amphoteric surfactant and its pH is adjusted to 9 to 12 with the basic compound. Such cleaning fluid is less likely to cause issues related to occupational health and to erode an adhesion site (e.g. a member of ahead) and is able to sufficiently clean the adhesion site to dissolve a dry film of the ink, and defective ejection can be improved. As a result, for example, even if an inkjet printer in which the ink described above has been left without being ejected for long time is in a condition which may cause defective ejection due to the ink adhered to an adhesion site, the cleaning fluid is able to remove a dry film and the like of the ink on the adhesion site. Thus the inkjet printer to which the cleaning fluid is used can subsequently eject the ink normally.

<Cleaning Method>

Now, the cleaning method of one aspect of the disclosed embodiment will be explained in detail. The cleaning method of the present aspect is, in an inkjet printer which ejects ink containing pigment and alkali-soluble resin having an acid group in a molecule, a method of cleaning an adhesion site to which the ink being ejected adheres, with a cleaning fluid. This cleaning fluid may consist of a single agent or two agents. It should be noted that, in the following description, each component constituting the cleaning fluid and the ink is same as those described in the above embodiment. Therefore, detailed explanations are omitted accordingly.

<When Cleaning Fluid Consists of a Single Agent>

When consisting of a single agent, the cleaning fluid contains at least one type of amphoteric surfactant selected from a group consisting of dimethyl lauryl amine oxide, lauryl dimethyl aminoacetic acid betaine, and 2-alkyl-n-carboxymethyl-n-hydroxyethyl imidazolium betaine, a basic compound, and water. The cleaning fluid is adjusted so that its pH is 9 to 12. Also, the amount of the amphoteric surfactant to the total amount of the cleaning fluid is adjusted to be 0.1 to 3% by mass.

With a cleaning method using this cleaning fluid, issues related to occupational health are less likely occur, an adhesion site (e.g. a member of ahead) is less likely to be eroded, the adhesion site is sufficiently cleaned and a dry film of the ink is dissolved, and defective ejection is improved. As a result, for example, even if an inkjet printer in which the ink has been left without being ejected for long time is in a condition which may cause defective ejection due to the ink adhered to an adhesion site, a dry film of the ink on the adhesion site can be removed by performing the cleaning method. Therefore, the inkjet printer on which the cleaning method is performed can subsequently eject the ink normally. Also, in the cleaning fluid, the amphoteric surfactant is contained in an amount of 0.1 to 3% by mass to the total amount of the cleaning fluid. Such cleaning fluid is less likely to form bubbles and easy in handling.

There is no particular limitation to a method of feeding the cleaning fluid which is prepared as a single agent. For example, with cloth impregnated with the cleaning fluid, the cleaning method can feed the cleaning fluid so that the ink adhered to an adhesion site and the dry film are wiped away directly. An operator may wipe away the ink adhered to an adhesion site with such cloth. Also, a cleaning mechanism comprising a portion which can absorb the cleaning fluid (e.g., sponge) may be attached to an aqueous inkjet printer. In this case, the inkjet printer can be configured to suitably absorb the cleaning fluid by sponge and the like and to wipe away ink adhered to an adhesion site (wiping). In this case, the dry film may be removed by a physical method which peels the ink off an adhesion site in addition to a chemical method which removes a dry film by dissolving it. Also, for example, with the cleaning fluid stored in a container, the cleaning method can continuously feed the cleaning fluid to an adhesion site by immersing the adhesion site (such as a member of a head) into the stored cleaning fluid. Besides, the cleaning fluid can be used, as well as ink, being filled in a nozzle, together with ink. Also, the cleaning fluid may be fed by being sprayed on an adhesion site. It should be noted that inside of a nozzle and the periphery of a nozzle hole, in which a dry film of the ink is especially easy to be formed are, as adhesion sites, sites where cleaning is intensively performed. Also, a cleaning method is suitably selected depending on a point of the adhesion site to be cleaned. For example, when inside of a nozzle and the periphery of a nozzle hole are cleaned, a cleaning method in which the nozzle ejects the cleaning fluid is suitably employed. On the other hand, when almost an entire surface of the side of an ejection hole of a head including the periphery of a nozzle hole is cleaned, wiping is suitably employed.

<When Cleaning fluid Consists of Two Agents>

When consisting of two agents, the cleaning fluid consists of a first agent which contains at least one type of amphoteric surfactant selected from a group consisting of dimethyl lauryl amine oxide, lauryl dimethyl aminoacetic acid betaine, and 2-alkyl-n-carboxymethyl-n-hydroxyethyl imidazolium betaine and water and a second agent which contains a basic compound and water. The cleaning fluid is fed so that the first agent and the second agent coexist at least at an adhesion site, the range of the pH of the mixture is from 9 to 12, and the amount of the amphoteric surfactant to the total amount of the fed cleaning fluid is 0.1 to 3% by mass.

As mentioned above, for the cleaning method of the present aspect, the first agent and the second agent need to coexist just at least at an adhesion site. Thus, the first agent and the second agent may be fed separately to an adhesion site or may be fed to an adhesion site in a state of being mixed in advance. In the following, each case will be explained.

<When First Agent and Second Agent are Fed Separately to Adhesion Site>

In this case, the first agent and the second agent are fed so that they are mixed at an adhesion site. Therefore, a mixing ratio of the first agent and the second agent can be adjusted at an adhesion site. Thus, the cleaning method can feed the first agent and the second agent to an adhesion site so that the pH of the cleaning fluid and a concentration of the amphoteric surfactant is suitable in consideration of degree of a thickness and the like of a dry film of the ink.

There is no particular limitation to a method of feeding the first agent and the second agent which are fed separately to an adhesion site. The first agent and the second agent can, for example by being fed to the same nozzle, clean that nozzle. In this case, a dry film of the ink which is adhered to the inside of the nozzle is dissolved by the fed cleaning fluid and removed. Also, the first agent and the second agent can be fed by being sprayed separately to an adhesion site. In addition, the first agent and the second agent can be fed to an adhesion site by wiping (wiping away) the adhesion site or immersing the adhesion site in the cleaning fluid after ejecting the first agent and the second agent in a fixed amount on a fibrous member or into a container so that the pH of the cleaning fluid and the amount of the amphoteric surfactant can be known and mixing those in the fibrous member or the container.

<When First Agent and Second Agent are Fed to Adhesion Site in a State of Being Mixed in Advance>

In this case, the first agent and the second agent are mixed in advance and then fed to an adhesion site. The cleaning fluid prepared as a single agent is easy in handling. Also, the first agent and the second agent can be mixed in advance and then fed to an adhesion site so that the pH of the cleaning fluid and a concentration of the amphoteric surfactant is suitable in consideration of degree of a thickness and the like of a dry film.

There is no particular limitation to a method of feeding the first agent and the second agent which are mixed in advance to an adhesion site. The first agent and the second agent can, for example, by being mixed in advance and then being fed to the same nozzle, clean that nozzle. In this case, a dry film of the ink and the like adhered inside of the nozzle are dissolved by the fed cleaning fluid and removed. Also, the first agent and the second agent can be fed by being mixed in advance and sprayed to an adhesion site.

As explained above, according to the cleaning method of the aspect, the cleaning fluid is suitably fed to an adhesion site to which the ink adheres. The cleaning fluid is less likely to cause issues related to occupational health and to erode an adhesion site (e.g. a member of a head) and is able to sufficiently clean and remove a dry film of the ink at the adhesion site. Therefore, for example, even if an inkjet printer in which the ink has been left without being ejected for long time is in a condition which may cause defective ejection due to a dry film of the ink firmly adhered to an adhesion site, the dry film of the ink and the like on the adhesion site is removed by performing the cleaning method of the embodiment. As a result, the inkjet printer on which the cleaning method is performed can subsequently eject the ink normally.

So far, one aspect of the presently disclosed embodiment has been explained. The presently disclosed embodiment is not limited to the cleaning fluid and the cleaning method described in the above aspect. In the above aspect, mainly the disclosed embodiment having the following constitution is explained.

(1) A cleaning fluid for cleaning a site to which a aqueous inkjet ink being ejected adheres (which may be simply referred to as an adhesion site hereinafter) in an inkjet printer which ejects the aqueous inkjet ink containing pigment and alkali-soluble resin having an acid group in a molecule, wherein the cleaning fluid contains an amphoteric surfactant, a basic compound, and water, a pH range of the cleaning fluid is from 9 to 12, the amphoteric surfactant is at least one selected from a group consisting of dimethyl lauryl amine oxide, lauryl dimethyl aminoacetic acid betaine, and 2-alkyl-n-carboxymethyl-n-hydroxyethyl imidazolium betaine and is contained in an amount of 0.1 to 3% by mass to the total amount of the cleaning fluid.

According to such constitution, the cleaning fluid does not require organic solvent. Also, the cleaning fluid contains, as amphoteric surfactant, at least one selected from a group consisting of dimethyl lauryl amine oxide, lauryl dimethyl aminoacetic acid betaine, and 2-alkyl-n-carboxymethyl-n-hydroxyethyl imidazolium betaine. The cleaning fluid contains a basic compound and its pH is adjusted to be 9 to 12.

Such cleaning fluid is less likely to cause issues related to occupational health and to erode an adhesion site (e.g. a member of a head) of the aqueous inkjet ink and is able to sufficiently clean the adhesion site and remove a dry film of the ink, and defective ejection can be improved. As a result, for example, even if an inkjet printer in which the ink has been left without being ejected for long time is in a condition which may cause defective ejection due to a dry film of the ink adhered to an adhesion site, the cleaning fluid can remove the dry film of the ink and the like on the adhesion site. Thus the inkjet printer to which the cleaning fluid is used can subsequently eject the ink normally. Also, in the cleaning fluid, such amphoteric surfactant is contained in an amount of 0.1 to 3% by mass to the total amount of the cleaning fluid. This cleaning fluid is less likely to form bubbles and easy in handling.

(2) The cleaning fluid according to (1), wherein the amphoteric surfactant contains at least dimethyl lauryl amine oxide.

According to such constitution, even if a dry film of the ink is firmly formed the cleaning fluid can sufficiently dissolve and remove it.

(3) The cleaning fluid according to (1) or (2), wherein the basic compound is sodium hydroxide or potassium hydroxide.

According to such constitution, the pH of the cleaning fluid is easy to be adjusted to 9 to 12. Also, sodium hydroxide and potassium hydroxide are strong bases. Therefore, cleaning effect of the cleaning fluid can be easily improved.

(4) The cleaning fluid according to any one of (1)-(3), wherein the pigment is contained in an amount of 8 to 12% by mass to the total amount of the aqueous inkjet ink.

According to such constitution, the aqueous inkjet ink contains a lot of the pigment. Such aqueous inkjet ink is able to maintain high color density even when printed with a fewer amount of ink droplets. As a result, transferring of a liquid component to printing paper decreases and that leads to advantages to quick drying property and inhibition of permeation of a coloring component into printing paper. On the other side, the total amount of solid content in the ink needs to be kept constant in order to maintain low viscosity of the ink. Thus, as an amount of the pigment, which is an insoluble component, has increased, an amount of the alkali-soluble resin, which is a soluble component, needs to be decreased instead. Such aqueous inkjet ink, as a result of combination of these, tends to form a dry film which is low in redissolubility and cause defective ejection. However, the cleaning fluid of the presently disclosed embodiment has sufficient cleaning performance and is able to clean and remove even a dry film containing a large amount of such ink.

(5) The cleaning fluid according to any one of (1)-(4), wherein an acid value of the alkali-soluble resin is 100 to 200 mg KOH/g.

According to such constitution, the acid value of the alkali-soluble resin is relatively low. Therefore, in the aqueous inkjet ink, desorption of an aqueous medium to the outside of system becomes easier to occur, and the ink has an excellent drying property. On the other hand, in such aqueous inkjet ink, portions (e.g., acid groups) which act to redissolve a dry film of the ink tend to decrease. However, the cleaning fluid of the presently disclosed embodiment shows excellent performance in effectively reacting a basic group of the basic compound contained in the cleaning fluid with an acid group contained in a molecule of the alkali-soluble resin and forming salt. Thus it can clean and remove even a dry film of such ink.

(6) a cleaning method for cleaning an adhesion site with a cleaning fluid to which the aqueous inkjet ink being ejected adheres, in an inkjet printer which ejects the aqueous inkjet ink containing a pigment and an alkali-soluble resin having an acid group in a molecule wherein the cleaning fluid contains amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazoliumbetaine, a basic compound, and water, it has a pH of 9 to 12, the amphoteric surfactant is contained in an amount of 0.1 to 3% by mass to the total amount of the cleaning fluid, and the cleaning fluid is fed to a site to which the aqueous inkjet ink adheres.

According to such constitution, the cleaning method uses a cleaning fluid which does not require organic solvent. Also, the cleaning fluid contains amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazoliumbetaine, a basic compound, and water, and it has a pH of 9 to 12. The amphoteric surfactant is contained in an amount of 0.1 to 3% by mass to the total amount of the cleaning fluid. According to the cleaning method using such cleaning fluid, issues related to occupational health are less likely to occur and an adhesion site (e.g. a member of a head) is less likely to be eroded, and the adhesion site is sufficiently cleaned, a dry film of the ink is removed, and defective ejection can be improved. As a result, for example, even if an inkjet printer in which the ink has been left without being ejected for long time is in a condition which may cause defective ejection due to a dry film of the ink adhered to an adhesion site, the dry film of the ink and the like on the adhesion site can be removed by implementing the cleaning method. Thus the inkjet printer to which the cleaning method is implemented can subsequently eject the ink normally. Also, in the cleaning fluid, the amphoteric surfactant is contained in an amount of 0.1 to 3% by mass to the total amount of the cleaning fluid. Such cleaning fluid is less likely to form bubbles and easy in handling.

(7) A cleaning method for cleaning an adhesion site with a cleaning fluid to which the aqueous inkjet ink being ejected adheres in an inkjet printer which ejects the aqueous inkjet ink containing a pigment and an alkali-soluble resin having an acid group in a molecule, wherein the cleaning fluid consists of a first agent containing an amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazolium betaine and water and a second agent containing a basic compound and water, and the cleaning fluid is fed so that the first agent and the second agent coexist at least at the adhesion site, a pH range of the cleaning fluid is from 9 to 12, and the amphoteric surfactant is contained in an amount of 0.1 to 3% by mass to the total amount of the cleaning fluid being fed.

According to such constitution, the cleaning method uses a cleaning fluid which does not require organic solvent. Also, the cleaning fluid consists of a first agent containing amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazolium betaine and water and a second agent containing a basic compound and water. This cleaning fluid is fed so that the first agent and the second agent coexist at least at the adhesion site to which the aqueous inkjet ink adheres. In a state of being fed to the adhesion site, the pH of the cleaning fluid is adjusted to 9 to 12 and an amount of the amphoteric surfactant is 0.1 to 3% by mass. According to the cleaning method using such cleaning fluid, issues related to occupational health are less likely to occur and an adhesion site (e.g. a member of a head) is less likely to be eroded, and the adhesion site is sufficiently cleaned, a dry film of the ink is removed, and defective ejection can be improved. As a result, for example, even if an inkjet printer in which the ink has been left without being ejected for long time is in a condition which may cause defective ejection due to the ink adhered to an adhesion site, the dry film of the ink and the like on the adhesion site can be removed by implementing the cleaning method. Thus the inkjet printer to which the cleaning fluid is implemented can subsequently eject the ink normally. Also, in the cleaning fluid fed to an adhesion site, the amphoteric surfactant is contained in an amount of 0.1 to 3% by mass to the total amount of the cleaning fluid. Such cleaning fluid is less likely to form bubbles and easy in handling.

(8) The cleaning method according to (7), wherein the first agent and the second agent are fed so that they are mixed at the adhesion site.

According to such constitution, the first agent and the second agent are fed so that they are mixed at an adhesion site. Therefore, the first agent and the second agent can be fed so that the pH of the cleaning fluid and a concentration of amphoteric surfactant is suitable in consideration of degree of a thickness and the like of a dry film of the ink.

(9) The cleaning method according to (7), wherein the first agent and the second agent are mixed in advance and then fed to the adhesion site.

According to such constitution, the first agent and the second agent are mixed in advance and then fed to an adhesion site. In other words, the first agent and the second agent are, after being prepared separately, suitably mixed before being fed to an adhesion site. The cleaning fluid which is prepared as a single agent is easy in handling. Also, the cleaning method can mix the first agent and the second agent and then feed them to an adhesion site so that the pH of the cleaning fluid and a concentration of the amphoteric surfactant is suitable in consideration of degree of a thickness and the like of a dry film.

(10) The cleaning method according to any one of (6)-(9), wherein the amphoteric surfactant contains at least dimethyl lauryl amine oxide.

According to such constitution, the cleaning method uses a cleaning fluid containing dimethyl lauryl amine oxide. Thus, even if a dry film of the ink is firmly formed, the dry film can be sufficiently dissolved and removed.

EXAMPLE

In the following, the presently disclosed embodiment will be explained in more detail according to examples. The presently disclosed embodiment is in no way limited by these examples. It should be noted that "%" means "% by mass" and "parts" means "parts by mass" unless particularly limited.

(Production of Aqueous Inkjet Ink Composition A)

An aqueous inkjet ink composition A was produced with the following materials.

(Carbon Black A)

Trade name: Printex 90 (average particle size: 14 nm, specific surface area: 300 $m^2/g$, pH: 9.0), manufactured by Degussa (Alkali-Soluble Resin A)

Acrylic acid/n-butyl acrylate/benzyl methacrylate/styren copolymer in which the glass transition temperature is 40° C., the mass average molar weight is 20,000, and the acid value is 100 mg KOH/g (Wax Emulsion A)

Nonionic emulsified polyethylene wax, trade name: HITECHE-6314 (solid content: 35%, average particle size: 100 nm), manufactured by TOHO CHEMICAL INDUSTRY Co., Ltd.

(Surfactant A)

Ethylene oxide adduct of acetylenic glycol, trade name: ACETYLENOL E100, manufactured by Kawaken Fine Chemicals Co., Ltd.

(Cation Exchange Resin)

Trade name: DOWEX MONOSPHERE (H) 650C, manufactured by The Dow Chemical Co.

(High-Pressure Emulsifying and Dispersing Apparatus)

Gaulin Homogenizer, manufactured by A. P. V. GAULIN INC.

By dissolving 25 parts by mass of alkali-soluble resin A into a mixed solution of 3.2 parts by mass of sodium hydroxide and 71.8 parts by mass of water, aqueous resin varnish A (25% by mass of alkali-soluble resin concentration) was obtained. By stirring and mixing 32 parts by mass of the obtained aqueous resin varnish A, 48 parts by mass of water, and 20 parts by mass of carbon black A and milling it with a wet type circulation mill, base ink A for aqueous inkjet was obtained. By diluting the obtained base ink A for aqueous inkjet 4 times with water, a dilute solution A was obtained. By adding 5 parts by mass of cation exchange resin to 100 parts by mass of the obtained dilute solution A, stirring it, and ion-exchanging it until the pH is less than 4, resin coated pigment A was obtained. Then, by filtrating the ion exchange resin with a mesh filter and sucking and filtrating water, water-containing cake which contains resin coated pigment A was obtained.

By adding sodium hydroxide of an amount which neutralizes 80% of the acid value of the alkali-soluble resin in the resin-coated pigment A to the obtained water-containing cake, diluting it with water so that the pigment concentration is 20%, and stirring it with a high-pressure emulsifying and dispersing apparatus, aqueous pigment dispersion A was obtained.

By stirring and mixing 60 parts by mass of the obtained aqueous pigment dispersion A, 5 parts by mass of wax emulsion A, 15 parts by mass of glycerin, 15 parts by mass of diethylene glycol, 1 pt. mass of surfactant, and 4 parts by mass of water, an aqueous inkjet ink composition A in which the pigment concentration is 12% by mass and pigment/alkali-soluble resin (weight)=10/4 was obtained.

Examples 1 to 9 and Comparative Examples 1 to 5

According to the formulations shown in table 1 below, by preparing materials in a beaker, and stirring and mixing them with a stirring apparatus, cleaning fluids of Examples 1 to 9 and Comparative Examples 1 to 5 were produced respectively. It should be noted that when an amount of the amphoteric surfactant identified in the presently disclosed embodiment is more than 3% by mass and when the pH is higher than 12, though the both cases were advantageous in terms of cleaning performance, a cleaning fluid was not produced this time because it was not preferable in terms of occupational health. According to the following evaluation methods, evaluation of dissolubility of dry films of the aqueous inkjet ink composition A and evaluation of improvability of defective ejection was conducted with the obtained cleaning fluids. Results are shown in table 1.

<Assessment of Dissolubility of Dry Film of Aqueous Inkjet Ink Composition A>

5 g of the aqueous inkjet ink composition A was prepared in a container and left for three months within an oven at 50° C. in an open system. 0.1 g of the obtained dry film of the ink were immersed in 5 g of respective cleaning fluids of Examples 1 TO 9 and Comparative Examples 1 to 5, and dissolubility of the dry film was evaluated according to the following evaluation criteria.

(Evaluation Criteria)

◎: The dry film began being dissolved as soon as it was immersed in the cleaning fluid, and all of it was dissolved.

○: The dry film began being dissolved when stirred lightly after being immersed in the cleaning fluid, and all of it was dissolved.

Δ: The dry film began being dissolved when stirred lightly after being immersed in the cleaning fluid, and part of it was dissolved.

×: The dry film was not dissolved even though it is stirred strongly after being immersed in the cleaning fluid.

<Evaluation of Improvability of Defective Ejection>

The aqueous inkjet ink composition A was filled to an inkjet printer (PX-105, manufactured by Seiko Epson Corporation), and successive sol id printing on 10 pieces of A4 size paper was conducted to confirm that the ink is filled. Then, the inkjet printer has been left in an oven at 50° C. for three months with the aqueous inkjet ink composition A being filled in a recording head. After leaving it for three months, defective ink eject ion (unsuccessful solid printing) was confirmed in a plurality of nozzles when nozzle check printing was conducted. In an initial filling mode, each cleaning fluid of Examples 1 to 9 and Comparative Examples 1 to 5 was filled in the recording heads in which defective ink ejection had occurred, and improvability of defective ejection was evaluated according to the following evaluation criteria.

(Evaluation Criteria)

◎: All of the nozzles were recovered with an initial filling sequence only, and defective ejection was improved.

○: All of the nozzles were recovered by conducting a cleaning operation one to two times after an initial filling sequence, and defective ejection was improved.

Δ: All of the nozzles were recovered by conducting a cleaning operation three times after an initial filling sequence, and defective ejection was improved.

×: Even though a cleaning operation was conducted three times after an initial filling sequence, unsuccessful solid printing occurred and defective ejection was not improved.

TABLE 1

| | Examples | | | | | | | | | Comparative Examples | | | | |
|---|---|---|---|---|---|---|---|---|---|---|---|---|---|---|
| | 1 | 2 | 3 | 4 | 5 | 6 | 7 | 8 | 9 | 1 | 2 | 3 | 4 | 5 |
| Water | 99.60 | 98.46 | 97.03 | 97.03 | 91.32 | 97.03 | 97.02 | 96.04 | 97.39 | 97.04 | 99.89 | 91.33 | 98.89 | 98.89 |
| Amphitol 20N (*1) | 0.29 (0.10) | 1.43 (0.50) | 2.86 (1.00) | 2.86 (1.00) | 8.57 (3.00) | 2.86 (1.00) | 2.86 (1.00) | — | — | 2.86 (1.00) | — | 8.57 (3.00) | — | — |
| Amphitol 24BN (*2) | — | — | — | — | — | — | — | 3.85 (1.00) | — | — | — | — | — | — |
| Amphitol 20Y-B (*3) | — | — | — | — | — | — | — | — | 2.50 (1.00) | — | — | — | — | — |
| Orphin E1010 (*4) | — | — | — | — | — | — | — | — | — | — | — | — | 1.00 (1.00) | — |
| Surfinol 485 (*5) | — | — | — | — | — | — | — | — | — | — | — | — | — | 1.00 (1.00) |
| Antiseptic (*6) | 0.10 | 0.10 | 0.10 | 0.10 | 0.10 | 0.10 | 0.10 | 0.10 | 0.10 | 0.10 | 0.10 | 0.10 | 0.10 | 0.10 |
| Potassium hydroxide | 0.01 | 0.01 | 0.01 | — | 0.01 | 0.005 | 0.02 | 0.01 | 0.01 | — | 0.01 | — | 0.01 | 0.01 |
| Sodium hydroxide | — | — | — | 0.007 | — | — | — | — | — | — | — | — | — | — |
| Total | 100.00 | 100.00 | 100.00 | 100.00 | 100.00 | 100.00 | 100.00 | 100.00 | 100.00 | 100.00 | 100.00 | 100.00 | 100.00 | 100.00 |
| pH | 10.5 | 10.5 | 10.5 | 10.4 | 10.5 | 9.3 | 11.8 | 10.5 | 10.5 | 7.2 | 10.5 | 7.2 | 10.5 | 10.5 |
| Dissolubility of dry film of ink | ○ | ◎ | ◎ | ◎ | ◎ | ○ | ◎ | ○ | ○ | X | X | Δ | X | X |
| Improvability of defective ejection | ○ | ○ | ◎ | ◎ | ◎ | ○ | ◎ | ○ | ○ | X | X | X | X | X |

(Values in parentheses are quantities in terms of active ingredients)

*1 Dimethyl lauryl amine oxide (active ingredient: 35%)

*2 Lauryl dimethyl aminoacetic acid betaine (active ingredient: 26%)

*3 2-alkyl-n-carboxymethyl-n-hydroxyethyl imidazolium betaine (active ingredient: 40%)

*4 polyoxyethylene acetylenic glycol ether (active ingredient: 100%)

*5 2,4,7,9-Tetramethyl-5-decyne-4,7-diol (active ingredient: 100%)

*6 Proxel GXL (S), manufactured by Lonza Japan Ltd.

As shown in table 1, the cleaning fluids produced in EXAMPLES 1 to 9 had good results in the both of the dissolubility of a dry film of the ink and the improvability of defective ejection.

On the other hand, the cleaning fluids of Comparative Example 1 and Comparative Example 3, which did not contain the basic compound and have low pH, were not able to dissolve the dry film nor improve defective ejection. Especially, the cleaning fluid of Comparative Example 3 was not able to dissolve the dry film nor improve defective ejection, even though it contained 3.00% by mass of the amphoteric surfactant in terms of active ingredient. The cleaning fluid of Comparative Example 2 which did not contain the amphoteric surfactant of the presently disclosed embodiment was not able to neither dissolve the dry film nor improve defective ejection. The cleaning fluids of Comparative Example 4 and Comparative Example 5 which used other surfactant instead of the amphoteric surfactant of the presently disclosed embodiment were not able to neither dissolve the dry film nor improve defective ejection. Especially, the cleaning fluid of Comparative Example 4 is an alteration of the cleaning fluid given as example 1 of Japanese Patent Document No. 2000-127419A in which the pH is raised from 9.2 to 10.5 while an amount of Orphin E1010 (polyoxyethylene acetylenic glycol ether) which is an active ingredient is maintained. Therefore, compared to the cleaning fluid of an example 1 of Japanese Patent Document No. 2000-127419A, the cleaning fluid of Comparative Example 4 is considered to have an enhanced cleaning performance for the raised pH. However, in evaluation of improvability of defective ejection of the above two cleaning fluids in the same operation with the same evaluation criteria as described in Japanese Patent Document No. 2000-127419A, the cleaning fluid of COMPARATIVE EXAMPLE 4 showed an extremely poor result of X, while the cleaning fluid of example 1 of Japanese Patent Document No. 2000-127419A showed an evaluation result of 0.

The difference between the results was made by the difference between the aqueous inkjet ink compositions used in the evaluation. In other words, this obviously shows how difficult employing alkali-soluble resin which has a pigment concentration of 12% by mass and an acid value of 100 mg KOH/g, keeping its amount up to 40% of the mass of the pigment, and improving defective ejection when the aqueous inkjet ink composition A which contains the base compound in an amount just as much as it neutralizes 80% of the acid value of the alkali-soluble resin is dried are. To put it the other way, the known cleaning fluids can be used not to all kinds of aqueous inkjet ink, at least, not to ink in which improvement of defective ejection is difficult, such as the aqueous inkjet ink composition A.

Also, Surfinol 485 (2, 4, 7, 9-Tetramethyl-5-decyne-4, 7-diol) contained in the cleaning fluid of Comparative Example 5 has the highest ability in lowering the surface tension of the system itself; however, the dry film of the ink was not dissolved at all and defective ejection was not improved even when it is contained to be 1.00% by mass.

As shown above, according to the examples and comparative examples, it has been found that in contrast to the fact that the known cleaning fluids lose their cleaning effects in an aqueous inkjet ink composition in which defective ejection is difficult to be improved, the cleaning fluids of the presently disclosed embodiment have excellent cleaning performance clearly different from those. Thus, it is shown that the cleaning fluid of the presently disclosed embodiment has high practical usability in an even wider range of types of ink, compared to the known cleaning fluids.

What is claimed is:

1. An organic solvent free cleaning fluid feedable through an inkjet recording head nozzle for cleaning a site to which a aqueous inkjet ink being ejected adheres in an inkjet printer which ejects the aqueous inkjet ink containing pigment and alkali-soluble resin having an acid group in a molecule, wherein the cleaning fluid contains an amphoteric surfactant, a basic compound, and water, the cleaning fluid does not contain organic solvent, a pH range of the cleaning fluid is from 9 to 12, the amphoteric surfactant is at least one selected from a group consisting of dimethyl lauryl amine oxide, lauryl dimethyl aminoacetic acid betaine, and 2-alkyl-n-carboxymethyl-n-hydroxyethyl imidazolium betaine and is contained in an amount of 0.1 to 3% by mass to the total amount of the cleaning fluid.

2. The cleaning fluid according to claim 1, wherein the amphoteric surfactant contains at least dimethyl lauryl amine oxide.

3. The cleaning fluid according to claim 1, wherein the basic compound is sodium hydroxide or potassium hydroxide.

4. The cleaning fluid according to claim 1, wherein the pigment is contained in an amount of 8 to 12% by mass to the total amount of the aqueous inkjet ink.

5. The cleaning fluid according to claim 1, wherein an acid value of the alkali-soluble resin is 100 to 200 mg KOH/g.

6. A cleaning method for cleaning a site with a cleaning fluid to which an aqueous inkjet ink being ejected adheres, in an inkjet printer which ejects the aqueous inkjet ink containing a pigment and an alkali-soluble resin having an acid group in a molecule, wherein the cleaning fluid contains an amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazolium betaine, a basic compound, and water, a pH range of the cleaning fluid is from 9 to 12, the amphoteric surfactant is contained in an amount of 0.1 to 3% by mass to the total amount of the cleaning fluid, and the cleaning fluid is fed to the site to which the aqueous inkjet ink adheres.

7. A cleaning method for cleaning a site with a cleaning fluid to which an aqueous inkjet ink being ejected adheres in an inkjet printer which ejects the aqueous inkjet ink containing a pigment and an alkali-soluble resin having an acid group in a molecule, wherein the cleaning fluid consists of a first agent containing an amphoteric surfactant which is at least one selected from a group consisting of dimethyl lauryl amine oxide, lauryl dimethyl aminoacetic acid betaine, and 2-alkyl-n-carboxymethyl-n-hydroxyethyl imidazolium betaine and water and a second agent containing a basic compound and water, and the cleaning fluid is fed so that the first agent and the second agent coexist at least at a site to which the aqueous inkjet ink adheres, a pH range of the cleaning fluid is from 9 to 12, and an amount of the amphoteric surfactant is 0.1 to 3% by mass to the total amount of the cleaning fluid being fed.

8. The cleaning method according to claim 7, wherein the first agent and the second agent are fed so that they are mixed at a site to which the aqueous inkjet ink adheres.

9. The cleaning method according to claim 7, wherein the first agent and the second agent are mixed in advance and then fed to a site to which the aqueous inkjet ink adheres.

10. The cleaning method according to claim 6, wherein the amphoteric surfactant contains at least dimethyl lauryl amine oxide.

* * * * *